US008308246B2

(12) United States Patent
Chung

(10) Patent No.: US 8,308,246 B2
(45) Date of Patent: Nov. 13, 2012

(54) METHOD FOR MANUFACTURING TOOTHBRUSH AND TOOTHBRUSH MANUFACTURED BY THE METHOD

(76) Inventor: Tae Sang Chung, Seongnam-si (KR)

( * ) Notice: Subject to any disclaimer, the term of this patent is extended or adjusted under 35 U.S.C. 154(b) by 365 days.

(21) Appl. No.: 12/727,585

(22) Filed: Mar. 19, 2010

(65) Prior Publication Data

US 2011/0225758 A1 Sep. 22, 2011

(51) Int. Cl.
*A46D 1/06* (2006.01)
*A46D 3/04* (2006.01)
*A46D 1/08* (2006.01)

(52) U.S. Cl. ..... 300/21; 300/4; 300/5

(58) Field of Classification Search ..... 300/2, 4, 300/5, 7, 8, 9, 21; *A46D 1/00, 3/00*
See application file for complete search history.

(56) References Cited

U.S. PATENT DOCUMENTS

| | | | | | |
|---|---|---|---|---|---|
| 2,438,156 | A | * | 3/1948 | Dodge | 428/95 |
| 2,655,409 | A | * | 10/1953 | Baldanza | 300/21 |
| 2,658,801 | A | * | 11/1953 | Goldberger | 300/21 |
| 3,633,974 | A | * | 1/1972 | Lewis, Jr. | 300/21 |
| RE27,455 | E | * | 8/1972 | Lewis, Jr. | 300/21 |
| 3,798,699 | A | * | 3/1974 | Lewis, Jr. | 15/179 |
| 4,132,449 | A | * | 1/1979 | Bergman | 300/4 |
| 4,188,429 | A | * | 2/1980 | Braconnier et al. | 428/85 |
| 4,233,260 | A | * | 11/1980 | d'Argembeau | 264/243 |
| 4,749,233 | A | * | 6/1988 | Weihrauch | 300/21 |
| 4,795,218 | A | * | 1/1989 | Seidler | 300/21 |
| 4,825,470 | A | * | 5/1989 | Horio | 2/161.8 |
| 5,518,300 | A | * | 5/1996 | Meyer | 300/21 |
| 5,622,411 | A | * | 4/1997 | Weihrauch | 300/21 |
| 6,726,789 | B1 | * | 4/2004 | Weihrauch | 156/72 |
| 7,281,768 | B2 | * | 10/2007 | Sato et al. | 300/4 |
| 7,641,287 | B2 | * | 1/2010 | Boucherie | 300/21 |
| 2003/0094848 | A1 | * | 5/2003 | Shia et al. | 300/21 |
| 2010/0043165 | A1 | * | 2/2010 | Juentgen et al. | 15/167.1 |

FOREIGN PATENT DOCUMENTS

| | | | |
|---|---|---|---|
| JP | 10-042956 | | 2/1998 |
| JP | 2001-275751 | | 10/2001 |
| JP | 2002-345561 | | 12/2002 |
| JP | 2006-116269 | | 5/2006 |
| JP | 2006-297028 | | 11/2006 |
| KR | 10-0405573 | | 11/2003 |
| KR | 10-2006-0095054 | | 8/2006 |
| KR | 10-2007-0017098 | | 2/2007 |
| WO | WO 9321795 | A1 * | 11/1993 |
| WO | WO 00/51462 | A1 * | 9/2000 |

* cited by examiner

*Primary Examiner* — Robyn Doan
*Assistant Examiner* — Tatiana Nobrega
(74) *Attorney, Agent, or Firm* — Cantor Colburn LLP

(57) ABSTRACT

A method of producing a bundle of bristles is provided and includes collecting a plurality of bristles substantially close together and fusing and subsequently hardening ends of the collected bristles to each other by cutting to thereby fuse the ends of the collected bristles using a heated cutter to thus produce a bundle of bristles.

8 Claims, 10 Drawing Sheets

[FIG. 2]
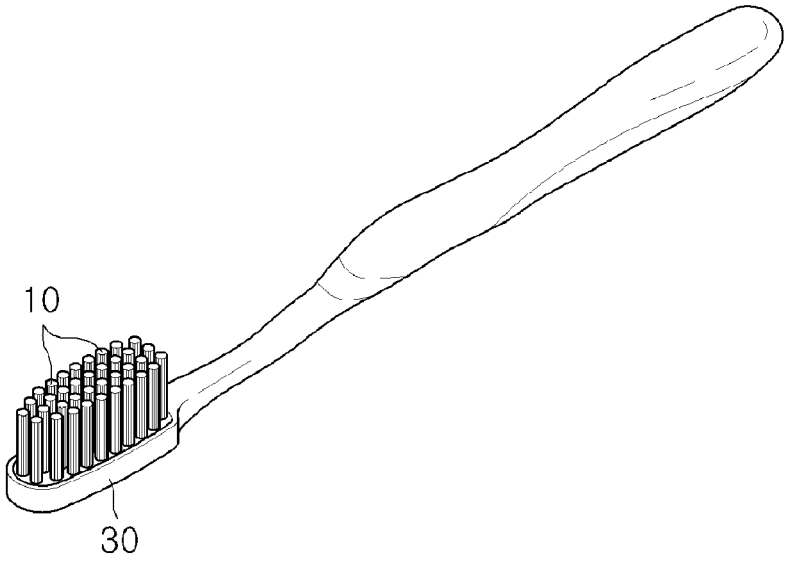
(A)
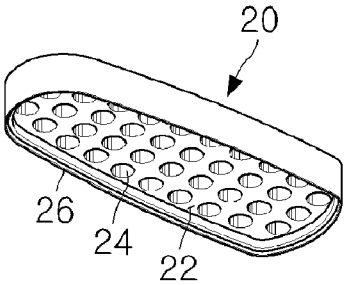
(B)
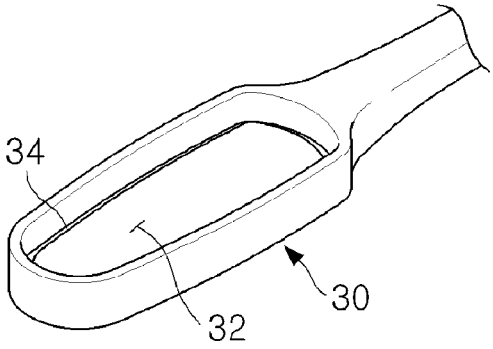
(C)

[FIG. 3]
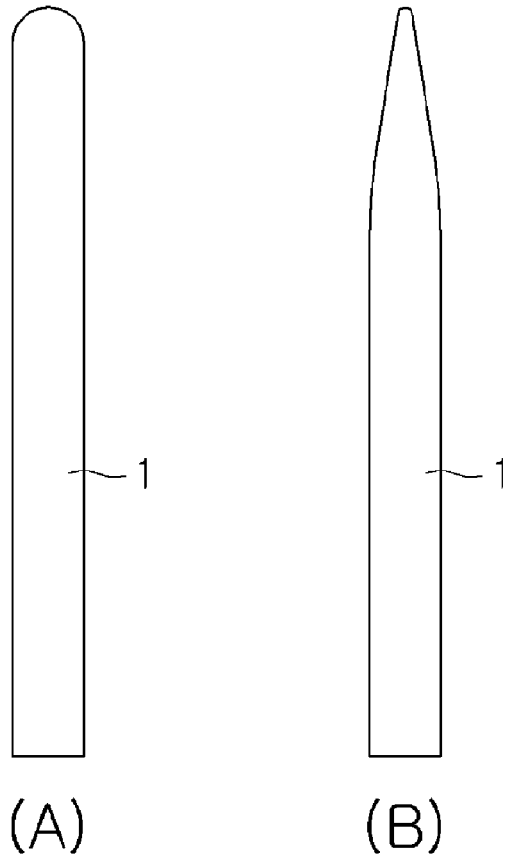
[FIG. 4]
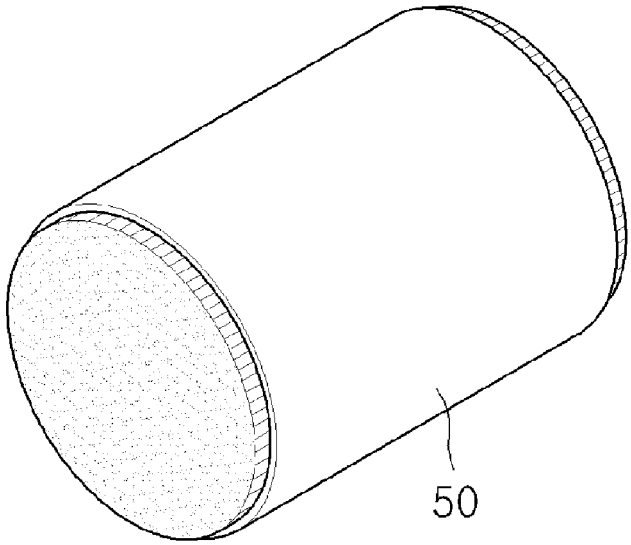

[FIG. 5]
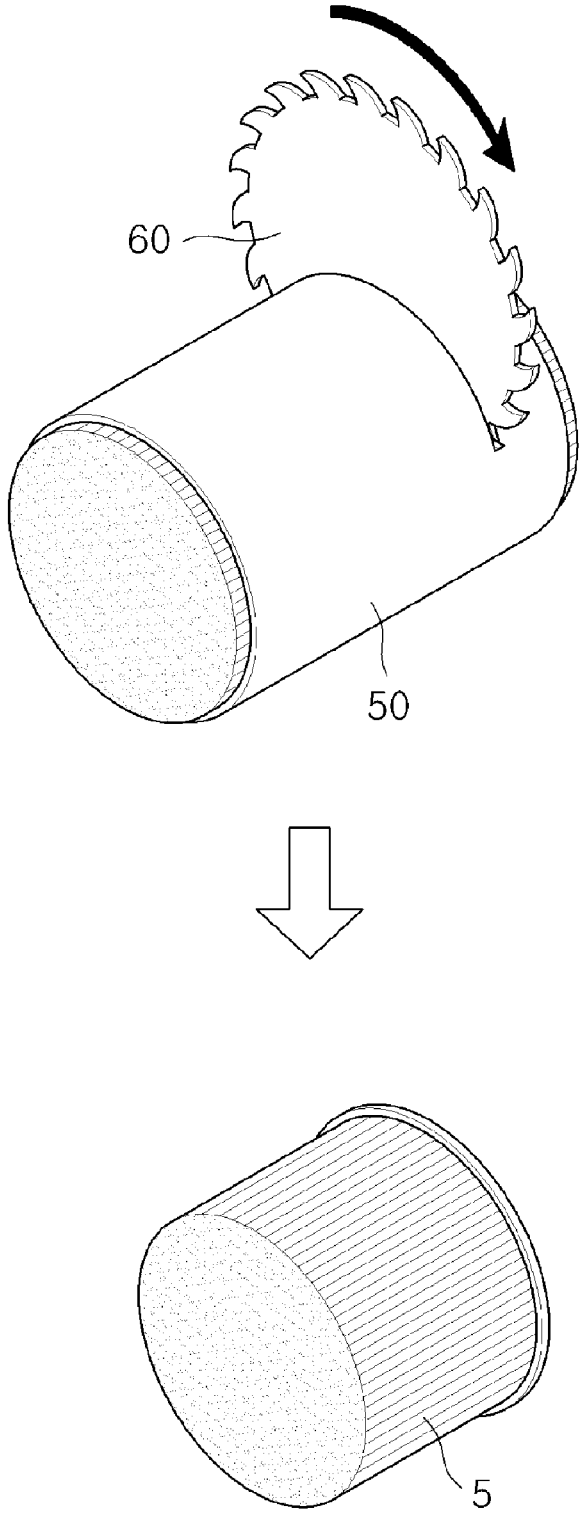

[FIG. 6]
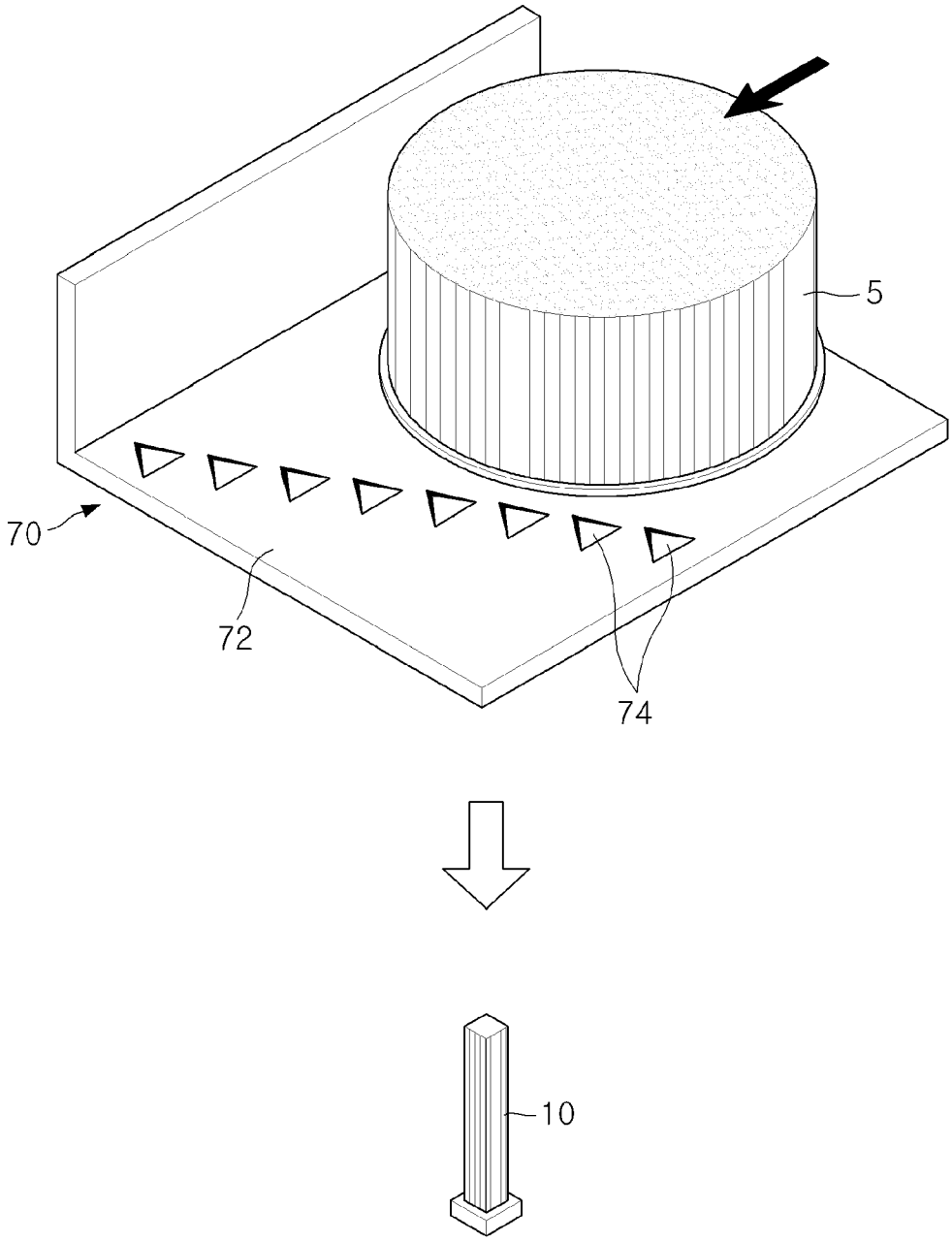

[FIG. 7]
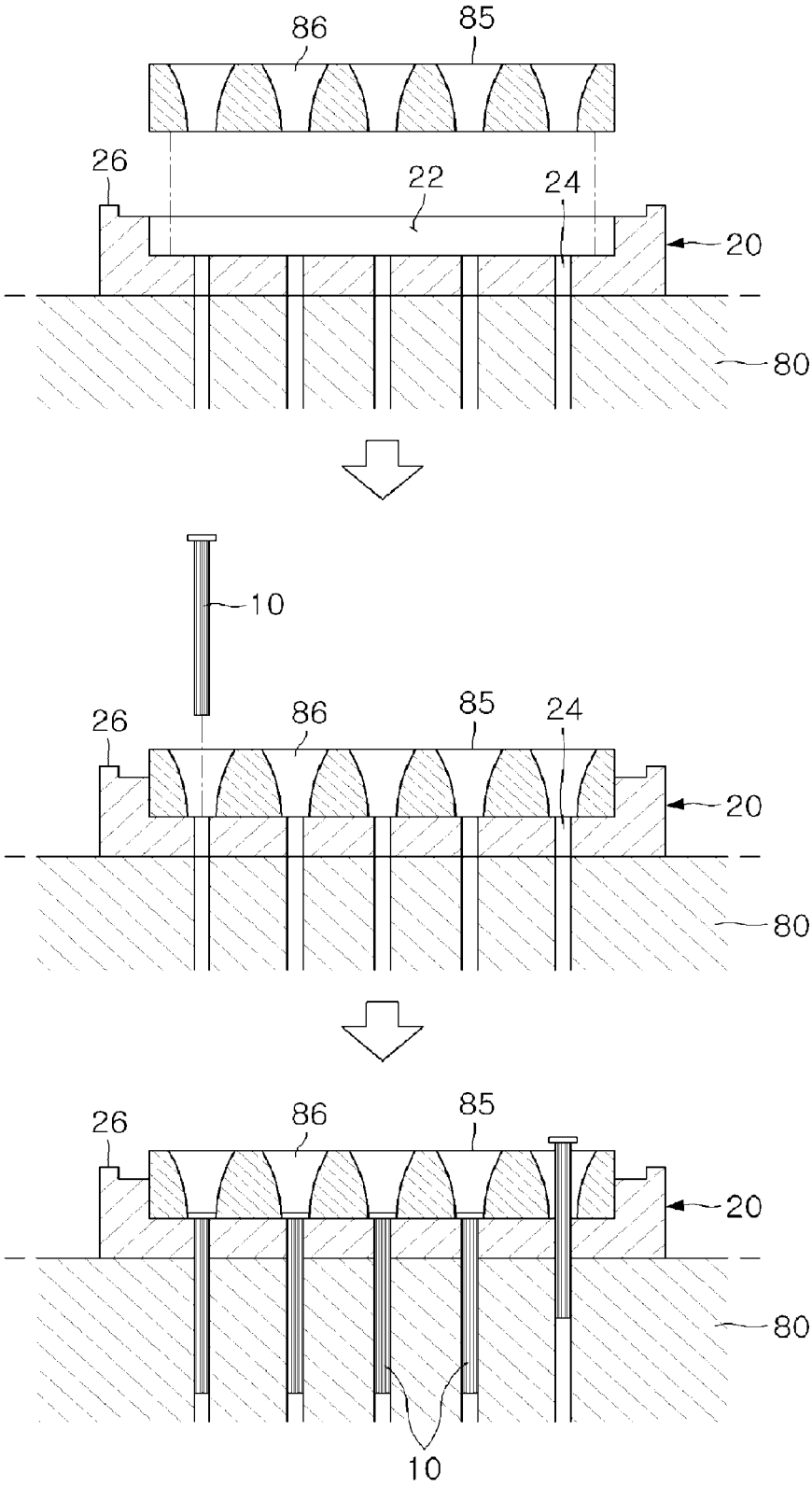

[FIG. 8]
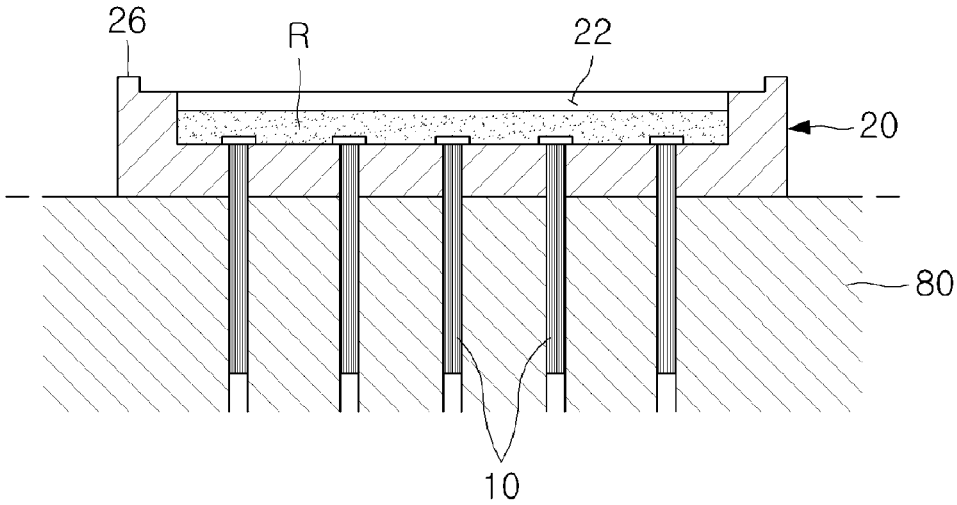
[FIG. 9]
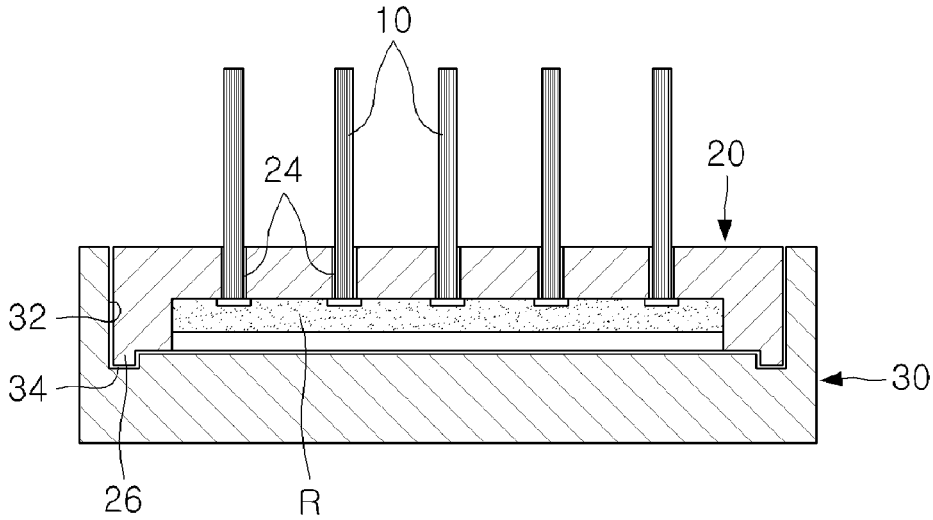

[FIG. 10]
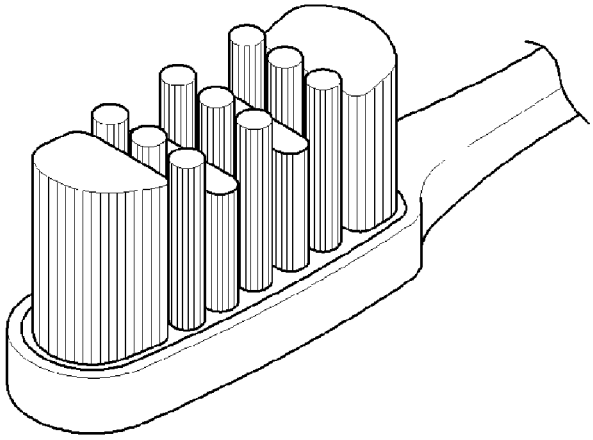
(A)
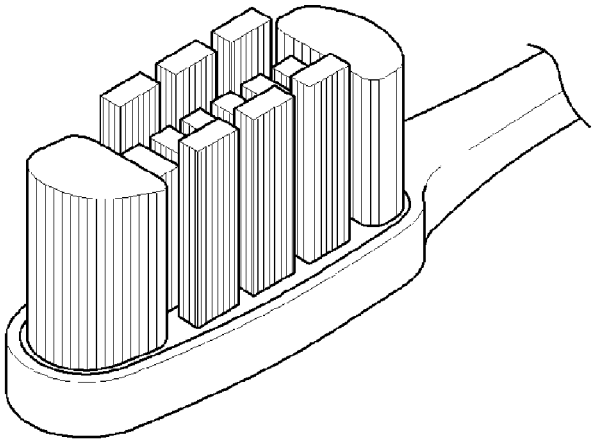
(B)

[FIG. 11]
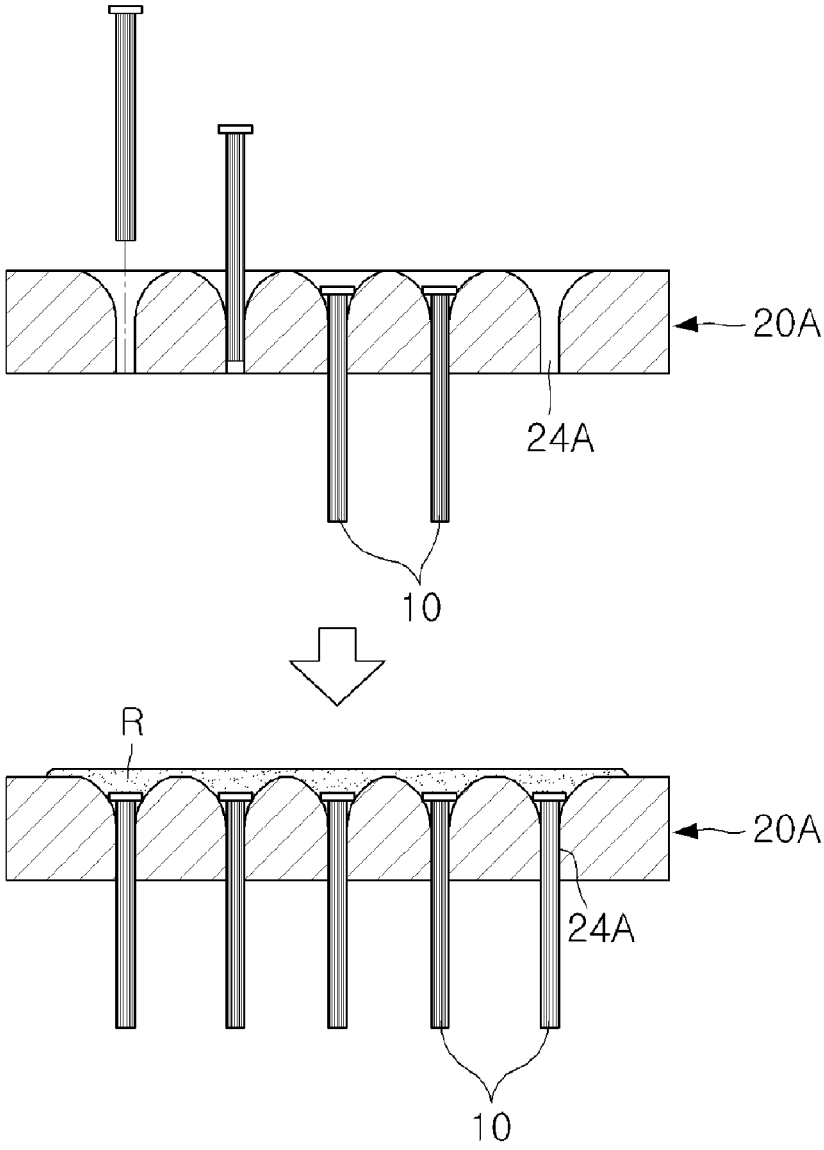

[FIG. 12]
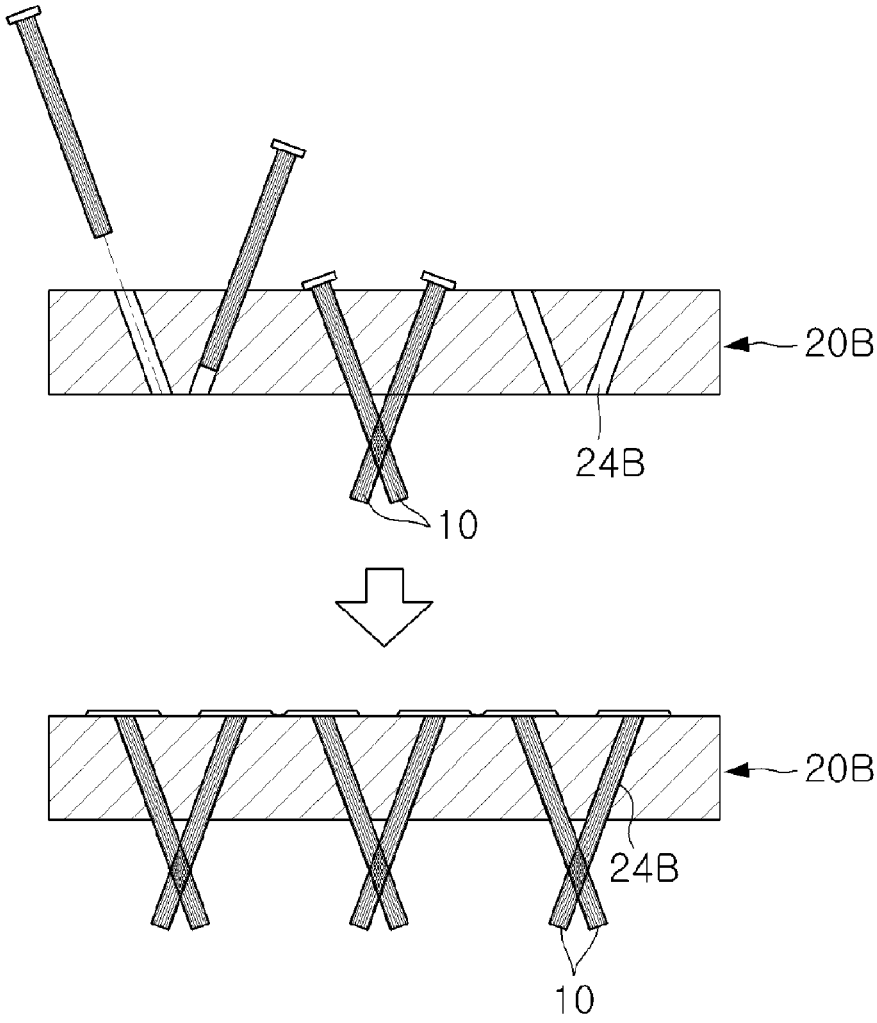

METHOD FOR MANUFACTURING TOOTHBRUSH AND TOOTHBRUSH MANUFACTURED BY THE METHOD

BACKGROUND

1. Field of the Invention

Aspects of the present invention relate to a method of manufacturing a toothbrush in which bristles are set in a toothbrush body without an anchor and a toothbrush manufactured by the method.

2. Description of the Related Art

Generally, when a method used to fasten bristles to a head part of a toothbrush body uses an anchor made of metal, the bristles relatively easily fall out of the head part as compared to when an "anchorless method," which does not require the use of an anchor, is used. Furthermore, when using the anchor, it is difficult to diversify the shape (length, thickness, color, etc.) of the bristles. Thus, most recent toothbrushes have been manufactured by the anchorless method.

A toothbrush manufactured by the anchorless method may include bristles, a planar head insert in which the bristles are set, and a toothbrush body which has a head part to which the head insert is coupled. The head insert has a plurality of setting holes and a plurality of bristles may be inserted into each setting hole. The operation of inserting the bristles into the setting hole typically includes inserting the lower parts of the bristles into the end of the setting hole using a heating apparatus, which corresponds to the upper surface of the head insert, such that the lower parts of the bristles are disposed on the lower surface of the head insert. Thereafter, the lower parts of the bristles are adhered to the head insert by fusing.

However, the anchorless method setting, which includes setting the bristles in each setting hole, has disadvantages including, for example, that it requires much time and labor when the setting the bristles in the each setting hole is conducted manually and that it cannot ensure the quality of the toothbrush.

To avoid these problems, an automatic system was recently proposed that was revealed to be complicated and very expensive. Moreover, the automatic system typically produces only one kind of toothbrush design. Hence, if a new toothbrush design is developed, part of or the entirety of the system must be changed, thus imposing a huge financial burden.

SUMMARY

According to an aspect of the invention, a method of producing a bundle of bristles is provided and includes collecting a plurality of bristles substantially close together and fusing and subsequently hardening ends of the collected bristles to each other by cutting the ends of the collected bristles using a heated cutter to thus produce a bundle of bristles.

According to another aspect of the invention, a method of manufacturing a toothbrush is provided and includes collecting a plurality of bristles substantially close together, cutting ends of the collected bristles using a heated cutter to thereby harden and fuse the cut ends of the collected bristles to each other to thus produce a bundle of bristles, cutting the fused bundle of bristles into a plurality of unit bundles of bristles having a predefined cross-sectional area corresponding to a setting hole of a toothbrush head insert, inserting parts of the bundle of bristles other than the fused parts thereof into the setting hole such that the fused parts of the bundle of bristles is disposed on a lower surface of the head insert, adhering the fused parts of the unit bundles of bristles to the head insert and coupling the head insert having the unit bundle of bristles fused thereto to a head part of the toothbrush.

According to another aspect of the invention, a method of manufacturing a toothbrush is provided and includes inserting bristles into a setting hole of a toothbrush head insert such that lower parts of the bristles are disposed on a lower surface of the head insert, adhering the lower parts of the bristles to the lower surface of the head insert using a heating apparatus and coupling the head insert having the bristles fused thereto to a head part of the toothbrush, where the inserting comprises inserting the bristles into the setting hole through a jig having a guide hole corresponding to the setting hole.

According to another aspect of the invention, a method of manufacturing a toothbrush is provided and includes inserting bristles into a setting hole of a toothbrush head insert such that lower parts of the bristles are disposed on a lower surface of the head insert, fastening the bristles to the head insert by application of adhesive to a lower surface of the head insert and a hardening of the adhesive and coupling the head insert having the bristles fastened thereto to a head part of the toothbrush.

According to yet another aspect of the invention, a toothbrush is provided and includes bristles, which are cut and thereby fused to each other at similar respective ends thereof, and which are arranged in a bundle having a predefined cross-sectional area, a head insert formed to define an inserting hole having a lower surface recessed from an upper surface thereof in which the bristles are set with the respective ends of the bristles adhered to the inserting hole lower surface and a head part to which the head insert is coupled.

According to yet another aspect of the invention, a toothbrush manufacturing method is provided and includes collecting bristles in a bundle thereof, each bristle having a first end to clean a user tooth and a second end opposite the first end, cutting the bundle proximate to the second ends using a heated cutter to thereby fuse the bristles, forming the bundle into a unit having a predefined cross-sectional shape, guiding the unit with the first ends leading the second ends into and through a setting hole formed in a head insert and having a shape corresponding to the unit cross-sectional shape such that the second ends align with a head insert recessed surface, adhering the second ends to the recessed surface and inserting the head insert into a toothbrush head.

BRIEF DESCRIPTION OF THE DRAWINGS

The above and/or other aspects, features and advantages of the present invention will be more clearly understood from the following detailed description taken in conjunction with the accompanying drawings, in which:

FIG. 2 illustrates an exemplary embodiment of a toothbrush manufactured by the method of manufacturing a toothbrush of FIG. 1 with FIG. 2(A) being a perspective view illustrating the entire toothbrush, FIG. 2(B) being a perspective view illustrating a head insert and FIG. 2(C) being a perspective view illustrating a head part;

FIGS. 3 through 9 are views showing the method of manufacturing a toothbrush with FIGS. 3(A and B) through 5 illustrating an operation of manufacturing bristles, FIG. 6 illustrating an operation of cutting bristles, FIGS. 7 and 8 illustrating an operation of setting bristles in the head insert and FIG. 9 illustrating an operation of coupling a head insert to a head part of a toothbrush;

FIGS. 10(A and B) are perspective views showing another exemplary embodiment of a toothbrush; and FIGS. 11 and 12 are views showing operations of setting bristles in head inserts having styles different from that of FIG. 2.

DETAILED DESCRIPTION

Figure 1:
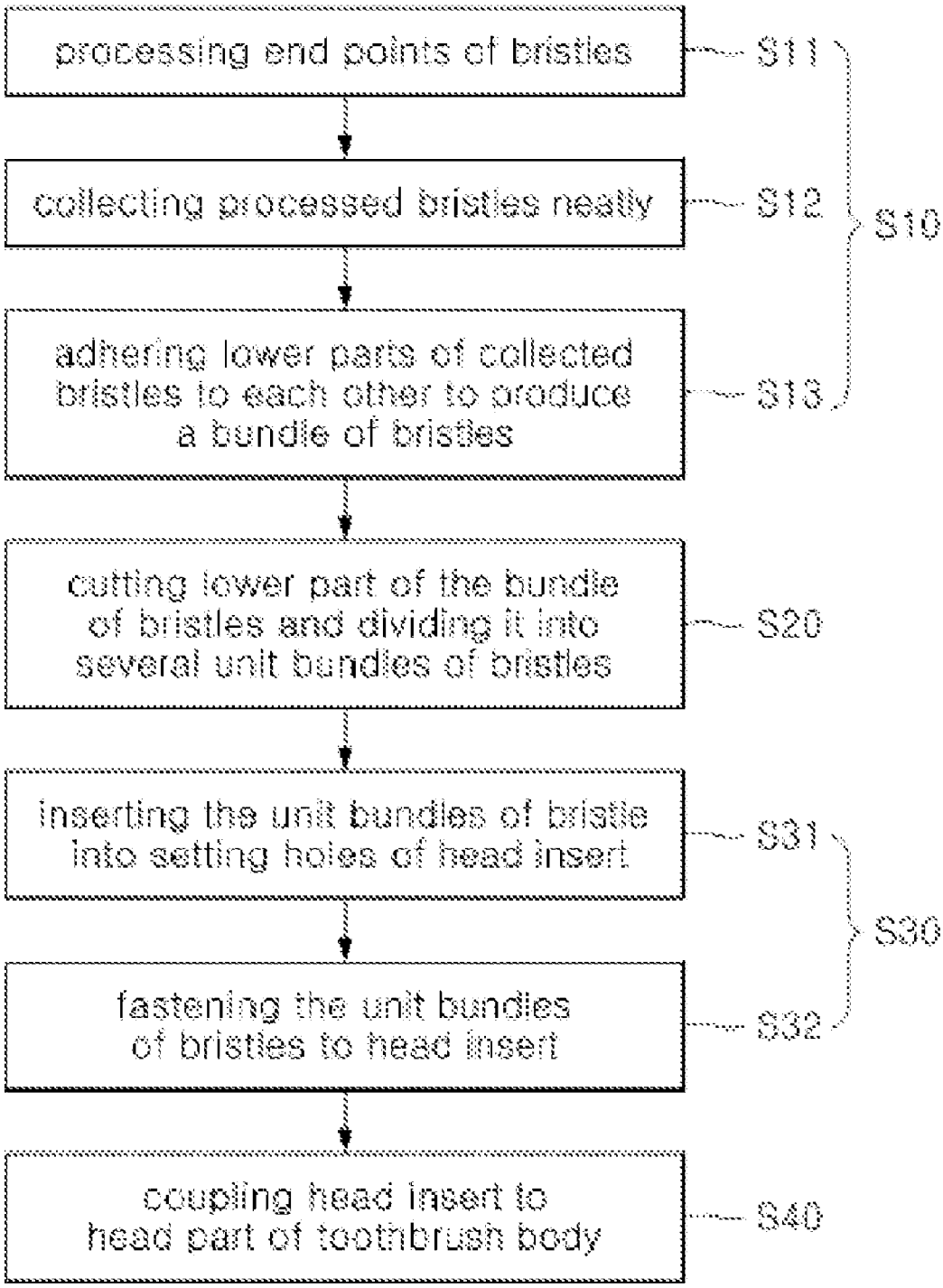
FIG. 1 is a flowchart of an exemplary embodiment of a method of manufacturing a toothbrush.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a flowchart of a method of manufacturing a toothbrush. As shown in FIG. 1, the toothbrush manufacturing method includes a bristle bundle producing operation S10, a bristle cutting operation S20, a bristle setting operation S30 and a head insert coupling operation S40. At operation S10, a bundle of bristles is produced by collecting bristles (referred to as the reference numeral 1 of FIG. 3). At operation S20, the produced bundle of bristles (referred to as the reference numeral 5 of FIGS. 5 and 6) is cut and divided into several unit bundles of bristles (referred to as the reference numeral 10 of FIGS. 2 and 6 through 9) having desired cross-sections. At operation S30, the unit bundles of bristles are set in a head insert (referred to as the reference numeral 20 of FIGS. 2 and 7 through 9). At operation S40, the head insert in which the bristles are set is coupled to a head part (referred to as the reference numeral 30 of FIGS. 2 and 9) of a toothbrush body.

FIGS. 2(A-C) illustrate an exemplary embodiment of a toothbrush manufactured by the toothbrush manufacturing method according to the present invention. As shown, the toothbrush includes bristles which comprise the unit bundles of bristles 10, a planar head insert 20 in which the bristles are set and a toothbrush body which includes a head part 30 to which the head insert 20 is coupled.

The head insert 20 has a recess 22 in a lower surface thereof. The recess 22 has an area other than the perimeter of the lower surface of the head insert 20. A plurality of setting holes 24 is formed in the recess 22. The unit bundles of bristles 10 are respectively set in the setting holes 24. In an exemplary embodiment, the setting holes 24 are substantially circular and have a same size, although additional exemplary embodiments are not limited thereto, and it is understood that the setting holes 24 may have other shapes and be variably sized. In an exemplary embodiment, the setting holes 24 may be formed spaced apart from each other at substantially regular intervals in the overall area of the recess 22, although additional exemplary embodiments are not limited thereto, and it is understood that the spacing intervals may be regular or varied.

The head part 30 has a receiving depression 32 into which the head insert 20 is fitted such that the lower surface of the head insert 20 is disposed opposite to, e.g., faces, a bottom of the receiving depression 32.

Bristle Bundle Producing Operation

As shown in FIG. 1, the bristle bundle producing operation S10 includes a bristle processing operation S11, a bristle collecting operation S12 and a bristle adhering operation S13.

With reference to FIG. 3, in the bristle processing operation S11, end points of the bristles 1 are processed by, for example, grinding or immersion treatment, such that when brushing the teeth of a user, tartar and plaque can be easily removed and injury to the users gums can be avoided or prevented. FIG. 3 illustrates processed bristles 1 with FIG. 3(A) showing a bristle 1 which is processed such that the end point thereof is rounded and FIG. 3(B) showing a bristle 1 which is processed such that the end point thereof is tapered.

With reference to FIG. 4, in the bristle collecting operation S12, a plurality of bristles 1, which have been processed through the bristle processing operation S11 is collected and arranged together relatively neatly. Thereafter, a paper band 50 or some other suitable wrapper wraps the bristles 1 to tie up the bristles 1 such that they are close together.

In place of the paper band 50, a tying frame having a hole or depression may be used to tie up the processed bristles 1. When the tying frame is used, the bristles 1 are densely inserted into the hole or depression of the tying frame, which may allow the shape in which the bristles 1 are collected to be relatively easily set due to the fact that the shape is determined depending on the shape of the hole or the depression of the tying frame. As an example, if the hole or depression of the tying frame is circular, the collected bristles are also circular.

The bristle collecting operation S12 may include a bristle arranging operation in which the collected bristles 1 are arranged such that the ends thereof form a predetermined shape. For example, the bristle arranging operation may be implemented in such a way that the lower parts of the collected bristles 1 are placed on a bristle arrangement plate, the upper surface of which has a predefined uneven shape, and the bristles 1 are pressed onto the bristle arrangement plate. The ends of the collected bristles 1 then become arranged in a similar shape as that of the upper surface of the bristle arrangement plate.

As shown in FIG. 5, at the bristle adhering operation S13, lower parts of the bristles 1 which have been collected at the bristle collecting operation S12 are adhered together such that the collected bristles 1 form a bundle of bristles.

The process of adhering the lower parts of the bristles 1 includes cutting the lower parts of the bristles 1 using a cutter 60 which is heated to a predetermined temperature (for example, using a cutter having a heating wire therein). When the collected bristles 1 are cut, the paper band 50 which maintains the collected state of the bristles 1, is also cut along with the bristles 1. The lower parts of the collected bristles 1 are melted by heat of the cutter 60 when they are cut and, subsequently, the lower parts of the collected bristles 1 are adhered together by hardening of the lower parts which have been melted.

As such, at the bristle adhering operation S13, a bundle of bristles 5 which is integrated by fusing of the lower parts of the bristles 1 is produced. Of course, if the bristle arranging operation was conducted at the bristle collecting operation S12, a bundle of bristles 5, the ends of which are arranged in a special shape, is produced.

With reference to FIG. 6, in the bristle cutting operation S20, the bundle of bristles 5 is divided into a plurality of unit bundles of bristles 10 which have cross-sectional areas corresponding to those of the setting holes 24 of the head insert 20. In an exemplary embodiment, a cutting tool 70 is used in the operation of dividing the bundle of bristles 5 into unit bundles of bristles 10. The cutting tool 70 includes a worktable 72 and a plurality of cutters 74 which are arranged in a line on the upper surface of the worktable 72.

The lower part of the bundle of bristles 5 is placed on the worktable 72 of the cutting tool 70 and pushed toward the cutters 74. Thereby, the adhered lower part of the bundle of bristles 5 is cut by the cutters 74, and the bundle of bristles 5 is thus divided into a plurality of bundles. Thereafter, the bundle of bristles 5 which has been divided into a plurality of bundles is rotated to about 90 degrees (°) and is cut once more in the same or a similar manner, thus forming several rectangular unit bundles of bristles 10. The intervals at which the cutters 74 are spaced apart from each other are set such that the unit bundles of bristles 10 which are formed at the above-mentioned bristle cutting operation have cross-sectional areas corresponding to the areas of the setting holes 24.

With reference to FIGS. 1, 7 and 8, the bristle setting operation S30 includes a bristle insert operation S31 and a bristle fastening operation S32.

With reference to FIG. 7, in the bristle insert operation S31, the head insert 20 is placed on a bristle setting base 80 such that the upper surface of the head insert 20 is brought into contact with the bristle setting base 80 and the lower surface thereof faces upwards. Thereafter, a jig 85 is placed on the lower surface of the head insert 20. The jig 85 has guide holes 86 which correspond in position to the setting holes 24 of the head insert 20 when the jig 85 is placed on the lower surface of the head insert 20. An outlet end of the guide hole 86 (e.g., a lower end of the guide hole 86 shown in FIG. 7) faces the corresponding setting hole 24 which has a size equal to or slightly greater than the cross-sectional area of the adhered lower part of the unit bundle of bristles 10. The cross-sectional area of the guide hole 86 is increased from the outlet end of the guide hole 86 to an inlet end thereof (e.g., an upper end of the guide hole 86 shown in FIG. 7).

The ends (opposite to the adhered lower part) of the unit bundles of bristles 10 are inserted into the inlet ends of the guide holes 86 and the unit bundles of bristles 10 are respectively inserted through the guide holes 86 into the setting holes 24 corresponding to the guide holes 86. The adhered lower parts of the unit bundles of bristles 10 are then disposed in the recess 22 of the head insert 20. Here, because each guide hole 86 is configured such that the size of the inlet end thereof is enlarged, each unit bundle of bristles 10 can be relatively easily inserted into and through the corresponding guide hole 86. Furthermore, the unit bundles of bristles 10, which are inserted into the corresponding guide holes 86, can be relatively easily inserted into the corresponding setting holes 24 along the inner surfaces of the guide holes 86. Therefore, the work of inserting the unit bundles of bristles 10 into the setting holes 24 can be relatively rapidly and precisely conducted. Following the inserting of the unit bundles of bristles 10 into the setting holes 24, the jig 85 is removed from the head insert 20.

In the bristle fastening operation S32 (refer to FIG. 8), an adhesive, e.g., thermoplastic resin R, in liquid form is charged into the recess 22 of the head insert 20 into which the unit bundles of bristles 10 are inserted. After a predefined time period has passed, the adhesive, e.g., the thermoplastic resin R, which has been in liquid form and has been charged into the recess 22 of the head insert 20 is cured or hardened. As such, the unit bundles of bristles 10 are fastened to the head insert 20. Thus, the head insert 20, the adhered lower parts of the unit bundles of bristles 10 and the adhesive, e.g., the thermoplastic resin R are integrated together by the hardening of the adhesive, e.g., the thermoplastic resin R.

If a head insert 20 (refer to FIG. 11) having no recess 22 is used, the adhesive, e.g., thermoplastic resin R, may be applied to the lower surface of the head insert 20 to a predetermined thickness rather than charging the adhesive, e.g., thermoplastic resin R, into the head insert 20.

The method of fastening the unit bundles of bristles 10 to the head insert 20 may also be implemented by inserting a heating apparatus, e.g., a heating plate, into the recess 22 of the head insert 20 and applying heat and pressure thereto such that the adhered lower parts of the unit bundles of bristles 10 are fused. In this case, when the fusing process is completed, the unit bundles of bristles 10 are fastened to the head insert 20.

With reference to FIGS. 1, 2 and 9, the head insert coupling operation S40 will be described. The head insert 20, which has passed through the bristle fastening operation S30, is fitted into the receiving depression 32 of the head part 30. Thereafter, contact surfaces between the head insert 20 and the head part 30 are adhered to each other using, e.g., ultrasonic waves. The head insert 20 and the head part 30 may have the following structures to enhance the coupling force therebetween.

The receiving depression 32 of the head part 30 may have a predetermined size, e.g., a size appropriate to forcibly fit the head insert 20 thereinto. Furthermore, a coupling groove 34 may be formed in the receiving depression 32 of the head part 30 along the perimeter of the receiving depression 32 and a coupling protrusion 26 may be provided on the perimeter of the lower surface of the head insert 20. The coupling protrusion 26 of the head insert 20 is fitted into the coupling groove 34 of the head part 30. In an exemplary embodiment, the head insert 20 is forcibly fitted into the receiving depression 32 and, the coupling protrusion 26 is fitted into the coupling groove 34. Therefore, the contact area and the contact strength between the head insert 20 and the head part 30 can be increased and, as a result, the coupling force between the head insert 20 and the head part 30 can be enhanced.

FIGS. 10(A and B) are perspective views showing other exemplary embodiments of a toothbrush manufactured by the toothbrush manufacturing methods described above. As shown in FIG. 10, toothbrushes having various styles of bristles can be simply manufactured at low cost. Each toothbrush shown in FIG. 10 may be manufactured by the above-mentioned methods or, alternatively, without the operations at which a bundle of bristles 5 having a predetermined cross-sectional area is produced and the bundle of bristles 5 are cut and divided into a plurality of unit bundles of bristles 10. That is, at the bristle bundle producing operation S10, the toothbrush may be manufactured in such a way as that bundles of bristles having cross-sections corresponding to relative setting holes 24 are produced, the bundles of bristles are set in a head insert 20, and the head insert 20 having the bundles of bristles is coupled to a head part 30 of a toothbrush body. Here, the typing frame which is stated in the description of the bristle collecting operation S12 may be used at the operation of producing the bundles of bristles having cross-sections corresponding to relative setting holes 24.

In this toothbrush manufacturing method, because the bundles of bristles, each lower part of which has an integrated structure, are set in the head insert 20, the quality of the manufactured toothbrush can be substantially increased. In addition, the arrangement and shape of the bristles can be diversified. Particularly, at the bristle collecting operation S12, if bristles 1 having different properties, e.g., different thicknesses, colors, shapes, are collected, a toothbrush in which various kinds of bristles 1 are set in each setting hole 24 may be manufactured.

FIG. 11 illustrates another exemplary embodiment of the operation of setting bristles in a head insert 20A having a different style from that of FIGS. 2 and 7 through 9. Setting holes 24A are formed through the head insert 20A. Each setting hole 24A is enlarged in size from a lower end thereof (when seen in the drawing) to an end thereof corresponding to the head part of the toothbrush. In the case of the setting hole 24A having the above-mentioned shape, the enlarged portion thereof acts in a similar fashion as the guide hole 86 of the jig 85. Therefore, where convenient, it is understood that the inserting of the unit bundles of bristles 10 into the setting holes 24A can be conducted without using the jig 85. Furthermore, the adhered lower parts of the unit bundles of bristles 10 which are inserted into the corresponding setting holes 24A are seated into the enlarged portions of the setting holes 24A. Thus, the force with which the unit bundles of bristles 10 are fastened to the head insert 20A can be further increased.

FIG. 12 illustrates still another exemplary embodiment of the operation of setting bristles in a head insert 20B having another style. In the case of FIG. 12, setting holes 24B are formed through the head insert 20B in directions that are inclined at predefined angles relative to one another and to the head insert 20B. In detail, adjacent setting holes 24B are inclined in directions opposite to each other. In the case where a toothbrush is manufactured using the head insert 20B, bristles are arranged in a shape such that the unit bundles of bristles 10 inserted into the setting holes 24B cross. For reference, in this embodiment, heating apparatus, e.g., heating plates, are used to fasten the unit bundles of bristles 10 to the head insert 20B, although additional exemplary embodiments are not limited thereto. That is, after the unit bundles of bristles 10 are inserted into the corresponding setting holes 24B, heat and pressure are applied to the adhered lower parts of the unit bundles of bristles 10 using the heating apparatus, e.g., the heating plate. Thereby, the adhered lower parts of the unit bundles of bristles 10 is fused to the lower surface of the head insert 20.

The present invention should not be construed as being limited to the exemplary embodiments set forth herein. Rather, these exemplary embodiments are provided so that this disclosure will be thorough and complete and will fully convey the concept of the present invention to those skilled in the art.

For instance, in the above description, although the bristle processing operation S11 of the bristle bundle producing operation S10 has been illustrated as being conducted before the bristle collecting operation S12 is conducted, the bristle processing operation S11 may be conducted after the bristle collecting operation S12. At an extreme, the bristle processing operation S11 may be conducted as the last operation of the toothbrush manufacturing method. Furthermore, the method of inserting bristles into the head insert using the jig at the bristle insert operation S31 of the bristle setting operation S30 and the method of fastening the bristles to the head insert by coating the head insert with the adhesive, e.g., thermoplastic resin, at the bristle fastening operation S32 may be used in a method in which bristles in the strand state are directly set in the head insert without producing a bundle form.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed:

1. A method of manufacturing a toothbrush, comprising:

producing a bundle of bristles, comprising:

collecting a plurality of bristles substantially close together;

fusing and subsequently hardening ends of the collected bristles to each other by cutting the ends of the collected bristles using a heated cutter to thus produce a bundle of bristles; and cutting the fused bundle of bristles into a plurality of smaller unit bundles of bristles having cross-sectional areas corresponding to sizes of setting holes of a head insert of a toothbrush;

inserting parts of the unit bundles of bristles other than fused parts thereof into corresponding setting holes of the head insert such that the fused parts of the unit bundles of bristles are disposed on a lower surface of the head insert;

adhering the fused parts of the unit bundles of bristles to the head insert; and coupling the head insert having the unit bundles of bristles adhered thereto to a head part of the toothbrush.

2. The method according to claim 1, wherein the inserting comprises inserting the unit bundles of bristles into the corresponding setting holes through a jig having corresponding guide holes.

3. The method according to claim 2, wherein an outlet end of each of the guide holes of the jig which faces the corresponding setting hole has a size equal to or greater than a cross-sectional area of an adhered part of the corresponding unit bundle of bristles.

4. The method according to claim 2, wherein each of the guide holes of the jig is increased in size at an inlet end thereof into which the corresponding unit bundle of bristles is inserted.

5. The method according to claim 1, wherein each of the setting holes of the head insert is increased in size at an end thereof corresponding to the lower surface of the head insert.

6. The method according to claim 1, wherein the adhering of the fused parts of the unit bundles of bristles to the head insert comprises:

applying adhesive to the lower surface of the head insert; and hardening the adhesive.

7. The method according to claim 6, wherein the head insert is formed to define a recess in which the setting holes are formed, and the adhesive is charged into the recess.

8. The method according to claim 1, wherein the producing a bundle of bristles further comprises producing a bundle of the collected bristles having a predetermined cross-sectional area.

* * * * *